United States Patent [19]

Gebauer et al.

[11] Patent Number: 5,073,092

[45] Date of Patent: Dec. 17, 1991

[54] DIAPHRAGM PUMP

[75] Inventors: Gerhard Gebauer, Bermatingen; Wilfried Goes, Meersburg; Otto Rosenauer, Langenargen, all of Fed. Rep. of Germany

[73] Assignee: J. Wagner GmbH, Fed. Rep. of Germany

[21] Appl. No.: 573,842

[22] Filed: Aug. 27, 1990

[30] Foreign Application Priority Data

Aug. 31, 1989 [DE] Fed. Rep. of Germany ..... 3928950

[51] Int. Cl.[5] ..... F09B 35/02

[52] U.S. Cl. ..... 417/383; 417/413; 417/234

[58] Field of Search ..... 417/413, 383, 385, 386, 417/387, 388, 234, 572, 361

[56] References Cited

U.S. PATENT DOCUMENTS

| | | | |
|---|---|---|---|
| Re. 29,055 | 11/1976 | Wagner . | |
| 2,812,895 | 11/1957 | Peeps | 417/234 |
| 3,305,137 | 2/1967 | Gauthier | 417/234 |
| 3,623,661 | 11/1971 | Wagner . | |
| 4,008,009 | 2/1977 | Kovacs | 417/387 |
| 4,378,038 | 3/1983 | Dolron | 417/234 |
| 4,828,464 | 5/1989 | Maier et al. . | |
| 4,934,906 | 6/1990 | Williams | 417/388 |
| 4,954,049 | 9/1990 | Armbruster | 417/234 |

FOREIGN PATENT DOCUMENTS

| | | | |
|---|---|---|---|
| 439980 | 2/1948 | Italy | 417/388 |

OTHER PUBLICATIONS

Wagner Gold Power 2500 brochure and Owner's Manual copyright 1983, Wagner Spray Tech Corporation.
Wagner Gold Power 1250 brochure and Owner's Manual copyright 1983, Wagner Spray Tech Corporation.
Wagner ProSeries brochure copyright 1986, Wagner Spray Tech Corporation.

*Primary Examiner*—Richard A. Bertsch
*Assistant Examiner*—Peter Korytnyk
*Attorney, Agent, or Firm*—Hill, Van Santen, Steadman & Simpson

[57] ABSTRACT

A diaphragm pump with a pumping component composed of a paint stage and propulsion stage; a hydraulic component; and an engine component such as a motor, fashioned such that, in a first predefined position or orientation the hydraulic component and the motor are mounted to each other in side-by-side arrangement, and the pumping component sits on top of the hydraulic component, whereby it is possible to cant the diaphragm pump by 90° and thus bring it into a second operable position for orientation. Unguided paint valves are thereby applied such that, in both positions of the pump, they enclose the same angle with the horizontal line. A measuring stick and an intake line are strategically arranged to be useable in both positions of the pump. A stationary support frame and a mobile support frame are presented to facilitate the flexible positioning or orientation of the pump.

18 Claims, 8 Drawing Sheets

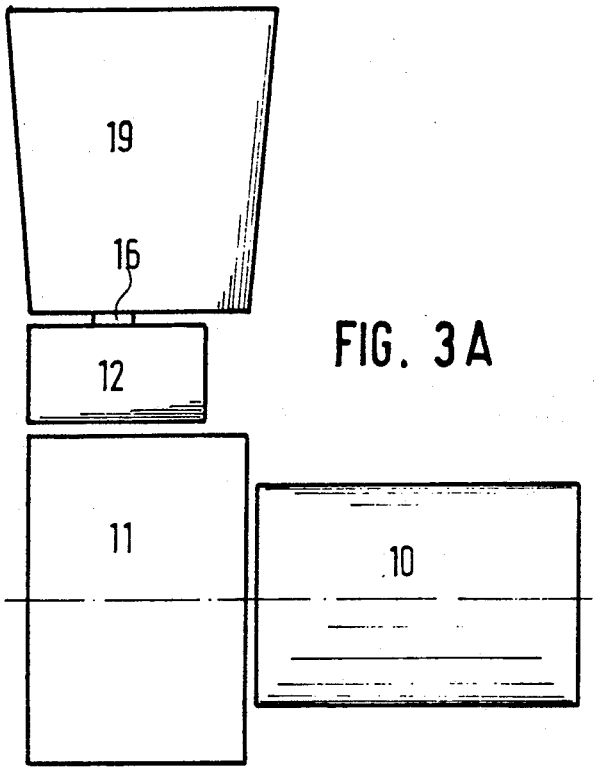
FIG. 3A
FIG. 3B
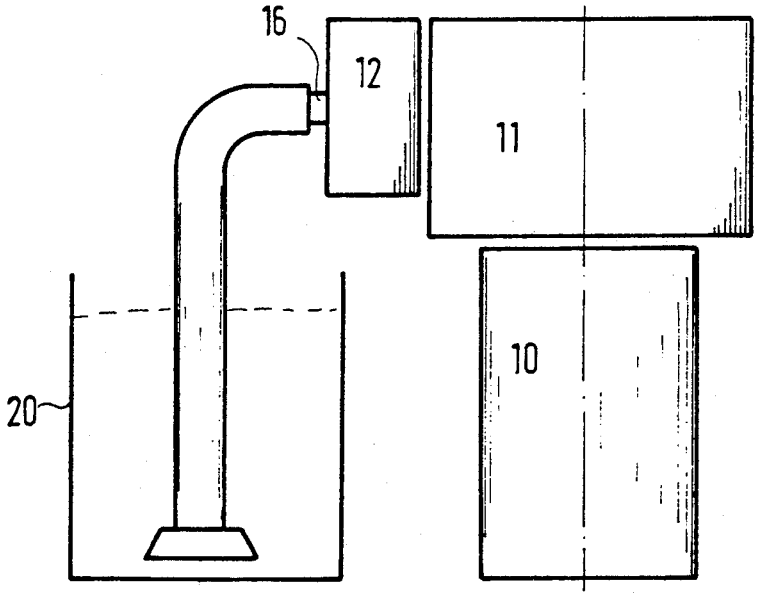

DIAPHRAGM PUMP

BACKGROUND OF THE INVENTION

The invention relates to a diaphragm pump with a pumping component which is divided by a diaphragm into two stages: a paint stage with a paint inlet valve and an unguided paint outlet valve, and a propulsion stage with a piston or ram oscillating normally to the diaphragm plane and a propulsion chamber located between the diaphragm and a leading front of the piston; and a hydraulic component representing a propulsion liquid supply container, which is connected via an intake line with the propulsion chamber of the propulsion stage. The container comprises a charging hole with a measuring stick for supplying and measuring the propulsion liquid, and in which an eccentric or cam, mounted on a shaft, for driving the piston of the propulsion stage, rotates. A motor is provided as engine component for the drive of the shaft holding the eccentric. Diaphragm pumps of this type have been known and have been available on the market for a long time in various embodiments.

Constructively, these known diaphragm pumps are respectively designed for a certain operating position. Thus, diaphragm pumps which are to be operated with a mountable paint container have a paint inlet valve vertically sticking out towards a top of the pump in order to be able to place the paint container on the pump and to directly connect it thereto. Diaphragm pumps, however, which are to be fed from a paint container to be placed beside the pump, are mostly provided with an inlet valve projecting out in laterally horizontal fashion in order to be able to insert a suction hose directly from the inlet valve into the paint container. If the first mentioned diaphragm pump is to be fed from a paint reservoir standing next to it, or if a mountable paint reservoir is to be placed upon the secondly mentioned diaphragm pump, suction hoses or tubes are necessary, bent double by 180°, which makes drawing the paint difficult or at least its start difficult.

SUMMARY OF THE INVENTION

It is an object of the present invention to fashion a diaphragm pump of the initially mentioned type such that it is fully suitable for two operating positions: a first position wherein a paint can or reservoir is mounted on top of the pump component and a second position wherein a paint can or reservoir is located laterally adjacent to the diaphragm pump.

Consequently, the pump of the invention can be arranged in two positions: the first position for the mounting of a mountable paint reservoir, the second position for the connection of a floor type paint reservoir, whereby the change from the one into the other position is achieved by a simple canting of the pump by 90°. Despite the fact that two positions can be achieved, no additional expenditure regarding the construction results compared to the conventional diaphragm pumps.

BRIEF DESCRIPTION OF THE DRAWINGS

FIG. 3A is a schematic elevational view of the connection of the diaphragm pump arranged in the first position with a mountable paint reservoir;

FIG. 3B is a schematic elevational view of the connection of the diaphragm pump arranged in the second position with a laterally adjacent paint reservoir;

DETAILED DESCRIPTION OF THE PREFERRED EMBODIMENTS

Figure 1:
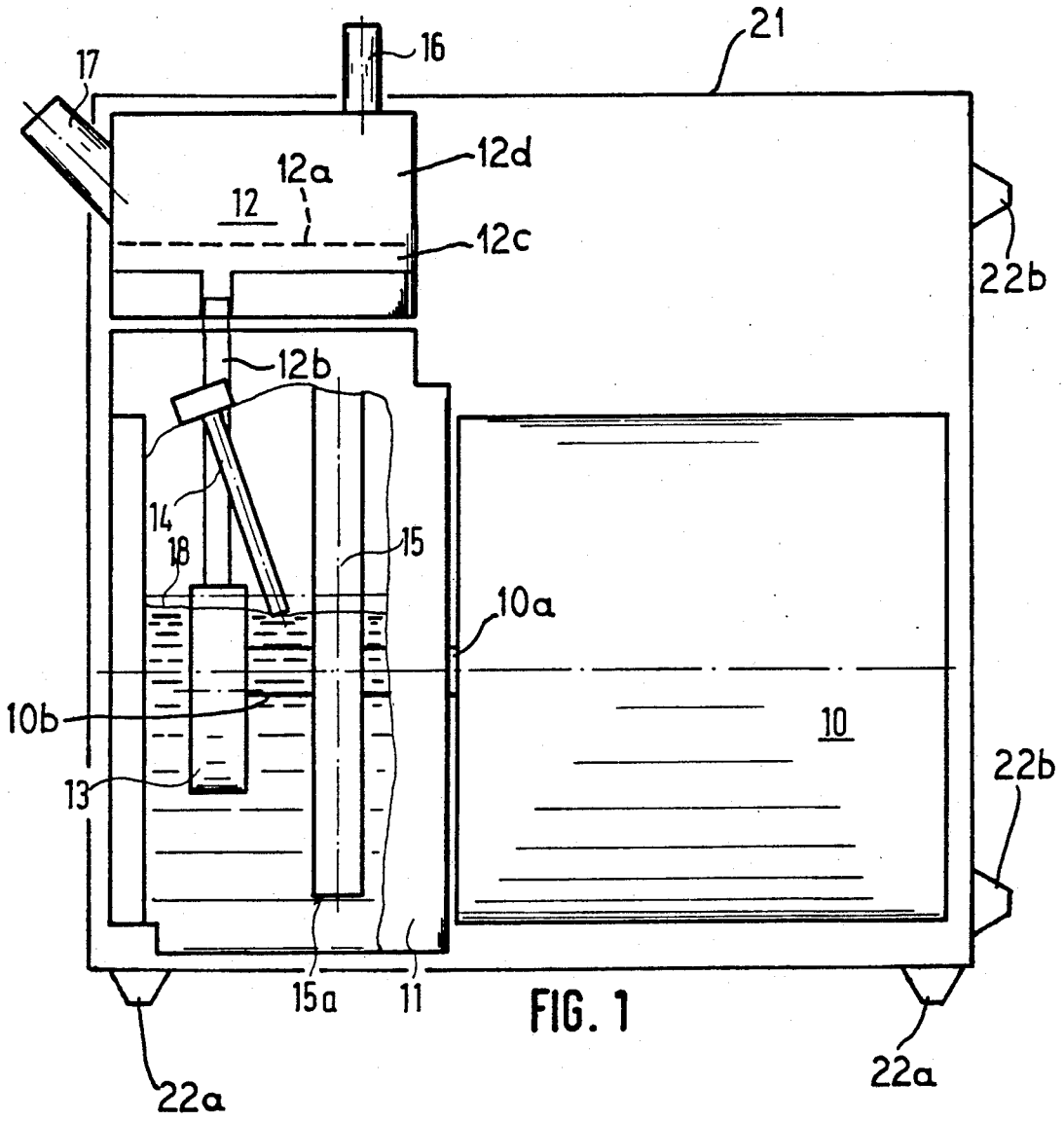
FIG. 1 is a schematic elevational view, in partial section, of a diphragm pump in a first position.
Figure 2:
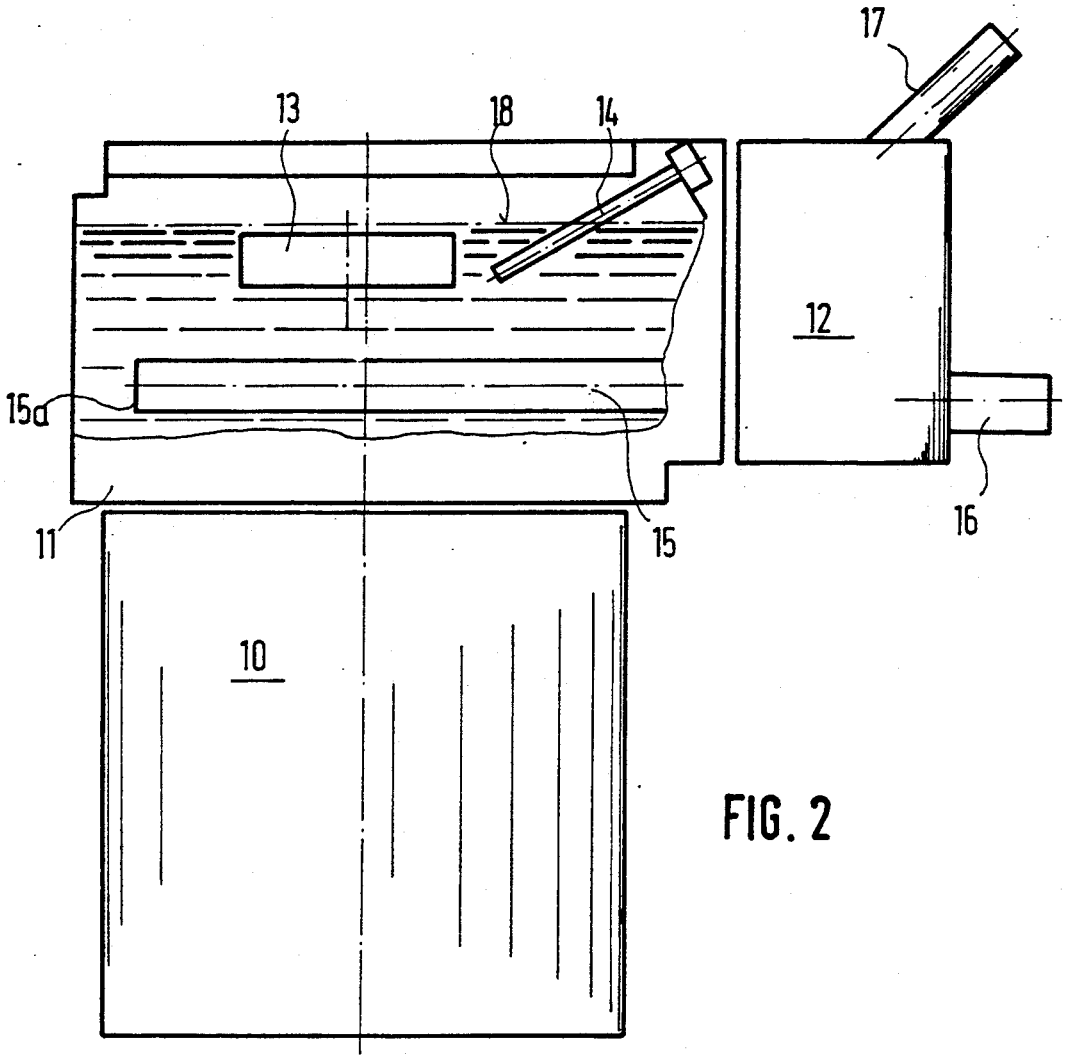
FIG. 2 is a schematic elevational view, in partial section, of the diaphragm pump of FIG. 1 in a second position.

FIGS. 1 and 2 are abbreviated representations of the diaphragm pump, whereby the elements that are in direct connection with the invention are shown. For a better understanding, a brief description of the known basic structure of such a diaphragm pump will follow.

The diaphragm pump is composed of three parts, namely a motor part 10, a hydraulic part 11 and a pumping part 12. The motor part 10 is an electro-motor of suitable power. The hydraulic part 11 is fashioned as supply tank for the hydraulic fluid and has a rotating shaft with an eccentric or cam 13 mounted thereon, a charging hole with integrated measuring stick 14 for the determination of the level of the hydraulic fluid, and a suction line 15 for the hydraulic fluid. The pumping part 12 is divided by a diaphragm **12*a* into a propulsion stage and a paint stage. In the propulsion stage, a ram or piston 12*b* oscillates in a direction normal to the diaphragm plane, whereby between an end of the ram and the diaphragm, a propulsion chamber 12*c* is located, filled with hydraulic fluid via the suction line 15 or the hydraulic stage. The paint stage is composed of paint chamber 12*d* bordering the diaphragm, as well as a paint inlet valve 16 and a paint outlet valve 17**, whereby the paint inlet valve is generally fashioned as a guided valve.

An unguided valve is a valve wherein performance of the valve is significantly affected by the axial orientation of the valve with respect to the force of gravity. The orientation of the unguided valve must be considered in selection and design. A guided valve is axially guided for movement and thus is relatively immune to variations in orientation to the horizontal. An example of a guided valve would be a spring closable stem supported valve, with the stem guided for axial movement to open and close the guided valve, such as is commonly used in an automobile engine. An example of an unguided valve is a valve having a poppet ball located in a compartment of the valve in unguided fashion with respect to axial movement to open and close the valve, and sitting by gravity, covering a valve seat. Hydraulic forces thus must overcome gravity to lift the ball to pass liquid through the valve seat.

During the operation of the diaphragm pump, the motor shaft of the electromotor drives the shaft holding the eccentric of the hydraulic part, and the thus rotating eccentric 13 indirectly or directly drives the ram of the propulsion stage of the pumping part. The hydraulic fluid in the propulsion chamber which is supplied via the suction line 15 transmits the ram movement to the diaphragm which, in turn, impacts the desired pressure on the paint located in the paint chamber and supplied via the paint inlet valve 16, whereby then the paint under pressure is discharged through the outlet valve 17.

It is worth noting that the allocation performed here of the cited components to the three parts 10, 11, 12 serves to simplify the understanding of the invention, functionally this particular allocation is not necessary or exclusive; thus, the ram and the propulsion chamber could also be allocated to the hydraulic component for example. It is relevant for explanation that the components are spatially arranged and fashioned in the manner as described in the following description.

In the position or orientation of the diaphragm pump according to FIG. 1, the motor component 10 and the hydraulic component 11 are connected with one another in a side-by-side arrangement such a motor shaft 10*a* of the electromotor 10 and a shaft 10*b* holding the eccentric 13 of the hydraulic component 11 are arranged in horizontal fashion, whereby the shaft holding the eccentric 13 proceeds in axial extension of the motor shaft. The two shafts are connected with each other or fashioned as one piece which is very simple in the case of electromotors. The pumping component 12 is fastened on the hydraulic component 11 such that the diaphragm 12*a* of the pumping component 12 extends itself in a horizonal plane, with the propulsion stage beneath the diaphragm, and the paint stage above the diaphragm. The ram 12*b* of the propulsion stage extends vertically from the eccentric, eccentric bearing or cam 13 of the hydraulic stage, upward into the propulsion stage. The measuring stick 14 is inserted into the charging hole of the hydraulic component 11 such that, relative to a vertical line, it has an oblique adjustment, approximately parallel to the diagonal or body diagonal of the hydraulic component 11. The intake opening 15*a* of the suction line 15 is located far below the fluid level indicated at 18. The paint inlet valve 16 projects, as usual, from a top side of the pumping component 12 vertically upward; the valve 16 is a guided valve. The paint outlet valve 17 is fashioned as an unguided valve and its longitudinal axis has a angle of inclination of 45° relative to the horizontal line. This position of the diaphragm pump is particularly suitable for the mounting of a paint-supply container on the upper side of the paint stage of the pumping component 12, as indicated in FIG. 3A, where a paint container 19 is put on the diaphragm pump.

FIG. 2 shows the second position or orientation of the diaphragm pump which results from the first position of FIG. 1 by a 90° canting. Here, the hydraulic component 11 is located above the motor component 10, whereby the motor shaft and the eccentric shaft extend in vertical fashion. The pumping component 12, however, is now arranged next to the hydraulic component 11, whereby the ram 12*b* oscillates in horizontal direction and the diaphragm 12*a* extends itself in a vertical plane. By the suitable dimensioning of the height and width of the hydraulic component 11 it is achieved that the level of the hydraulic fluid is again at a proper level, without taking out or filling in hydraulic fluid, as is desired for the operation, for example to barely cover the eccentric bearing 13. The inclination of the axis of the measuring stick as described above is approximately parallel to the diagonal of the hydraulic component 11. The guided inlet valve 16 now proceeds horizontally, whereas the outlet valve 17 has again an adjustment of 45° relative to the horizontal line, i.e., an oblique inclination equal to that of the position of FIG. 1. In both positions of the diaphragm pump, the unguided outlet valve 17 is thus subjected to gravity in the same manner so that, in both the first and the second positions, the valve 17 operates in the same way and no adjustment is necessary when the diaphragm pump is brought from the one into the respective other position. Although the inlet valve 16 extends itself in different directions in the two positions, the directions being perpendicular to each other, this is without significance since this valve, as mentioned, is a guided valve. The position of FIG. 2 is particularly suitable for the case whereby the paint is taken out of a floor container, as for example the paint reservoir or container 20 shown in FIG. 3B.

In order to enable operation of the diaphragm pump in a horizontal or vertical position with the assistance of simple means, the diaphragm pump can be provided with a housing-like casing 21 at which, for each of the first and second position, feet to place the pump on the floor are located. The casing 21 is shown schematically in FIG. 1. Support feet 22*a* are used in the first position, alternate support feet 22*b* are used in the second position. Four support feet 22*a* and four support feet 22*b* are preferred, spaced in a typical rectangular arrangement. For an easier carrying of the diaphragm pump, handles can be additionally attached at the housing as for example, two pipe handles bent in U-shaped fashion.

Figure 4B:
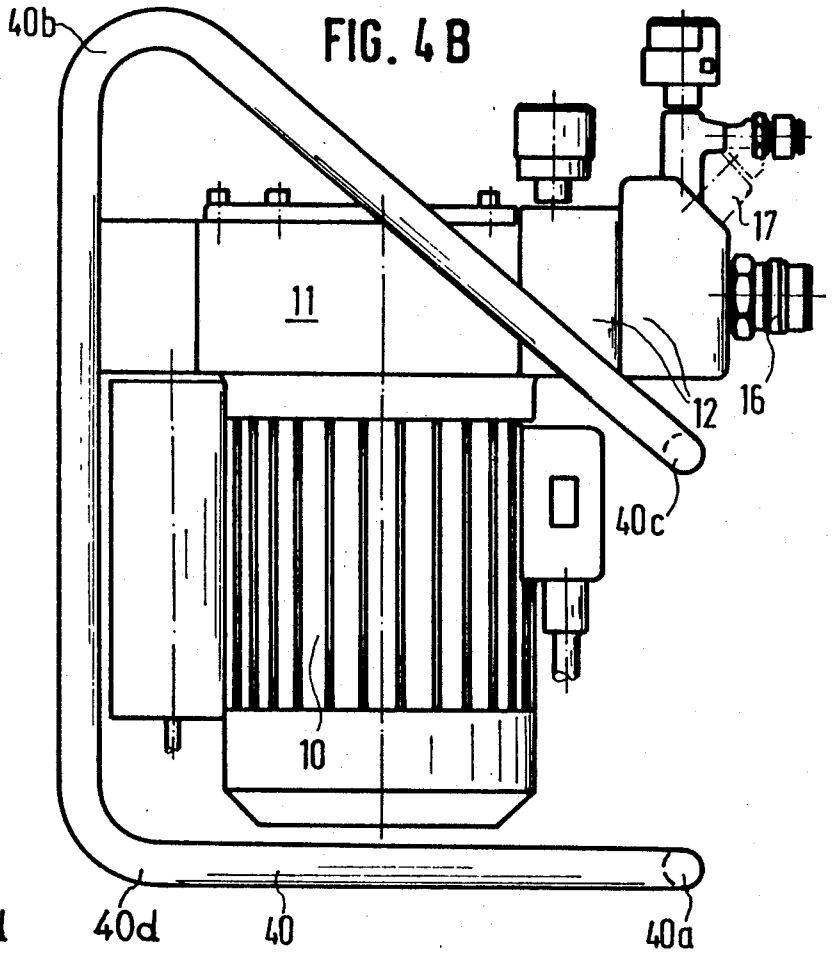
FIG. 4B is an elevational view of the diaphragm pump in the second position with the floor type frame and hand carrier.
Figure 4A:
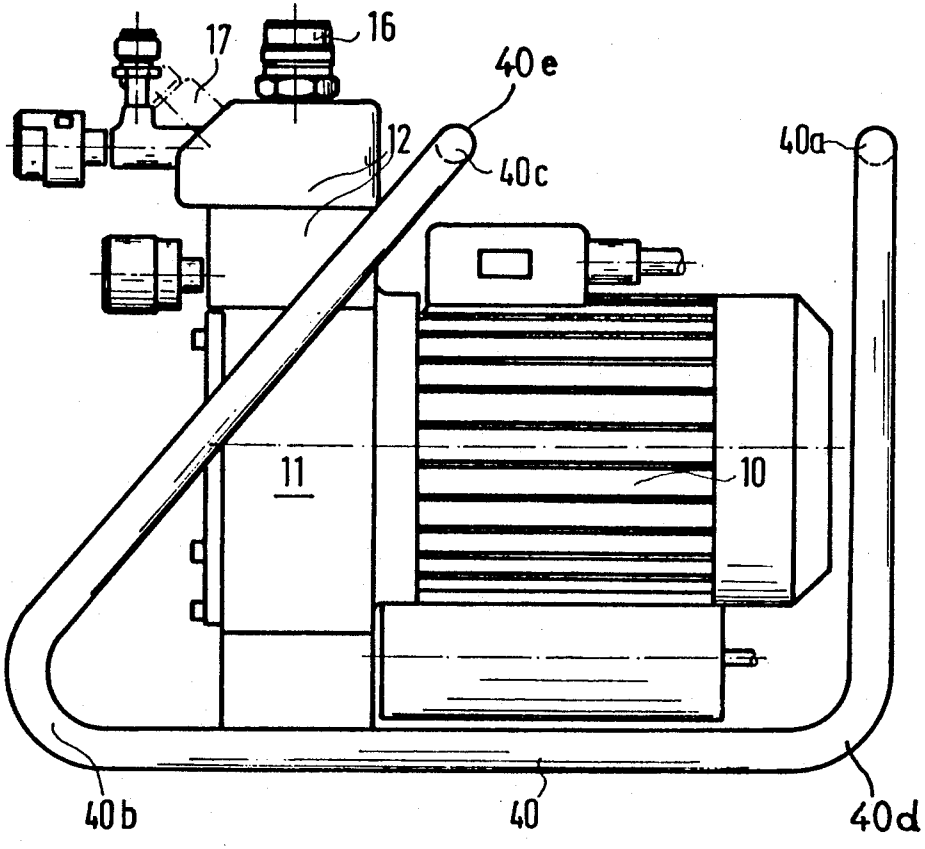
FIG. 4A is an elevational view of the diaphragm pump in the first position connected with a floor type frame and hand carrier.
Figure 4C:
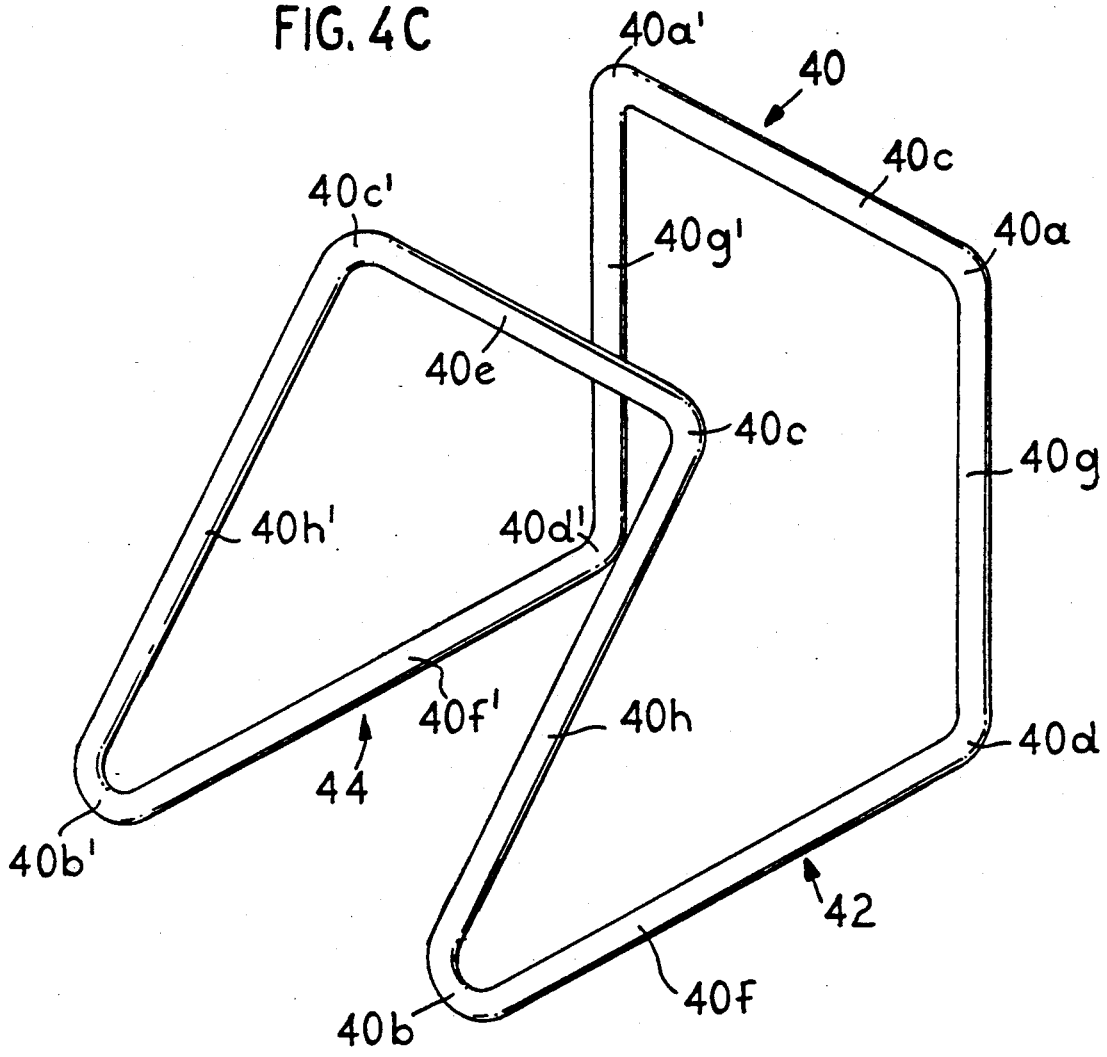
FIG. 4C is a perspective view of the floor type frame of FIGS. 4A and 4B with the diaphragm pump removed.

As an alternative to the protective housing, the diaphragm pump can also be placed in a frame which has feet or feet-like shapings for positioning the pump in both the first and second positions. The frame itself can be fashioned such that it can accept the complete pump, and has applied handles as well, whereby regarding the arrangement of the handles the respective gravity position of the pump-frame-unit must be observed. In FIGS. 4A and 4B, such a frame 40 is fastened at the pump. The frame 40 is composed of one single piece of pipe, which is bent correspondingly, whereupon its meeting ends are connected with each other so that a endless pipe configuration results. With reference to FIG. 4A and 4C a first bent 42 is described as the pipe 40 proceeds from a point 40*a* vertically to a bottom or support surface, to a first bend 40*d*, then proceeds horizontally to a second bend 40*b* at which the pipe proceeds obliquely to a top elevation to a third bend 40*c*. At the third bend 40*c* the pipe is bent by 90° to a horizontal orientation to a back position on an opposite side of the diaphragm pump, the pipe thereupon bends to form a second bent 44 identical to the first bent, in a plane parallel to the plane of a projection on the page of FIG. 4A. The pipe 40 proceeds correspondingly to the visible first bent via a fourth bend 40*c*', to a fifth bend 40*b*', to a sixth bend 40*d*', to a seventh bend 40*a*, where it is bent in a horizontal orientation such that its proceeds horizontally to the front of the plane of projection of FIG. 4*a* to the visible location of the point 40*a*. The bends 40*a*, 40*b* and 40*a'*, 40*c'* form open ends of the U-shaped bents 42, 44 facing upwardly. Closed segments 40*f*, 40*f'* act together as a first support surface. The first U-shaped bent 42 has a first upstanding leg 40*g* and a second upstanding leg 40*h*. Similarly, the second U-shaped bent 44 has a third upstanding leg 40*g'* and a fourth upstanding leg 40*h'*. The first upstanding leg 40*g* is connected to the third upstanding leg 40*g'* by horizontally arranged cross member 40*i*. The second upstanding leg 40*h* is connected to the fourth upstanding leg 40*h'* by the horizontally arranged cross member 40*e*. This simple but effective pipe frame 40 guarantees an excellent position of the pump in both the first and second positions as shown in FIGS. 4A and 4B. In the position of FIG. 4A, the pump-frame-unit can be carried by a user at a cross tube 40*e* originating at 40*c* to 40*c'*, and in the second position of FIG. 4B can be carried at the second bend 40*b*, and the parallel fifth bend 40*b'*, which also can be connected with each other by a horizontal pipe piece (not shown).

Figure 5A:
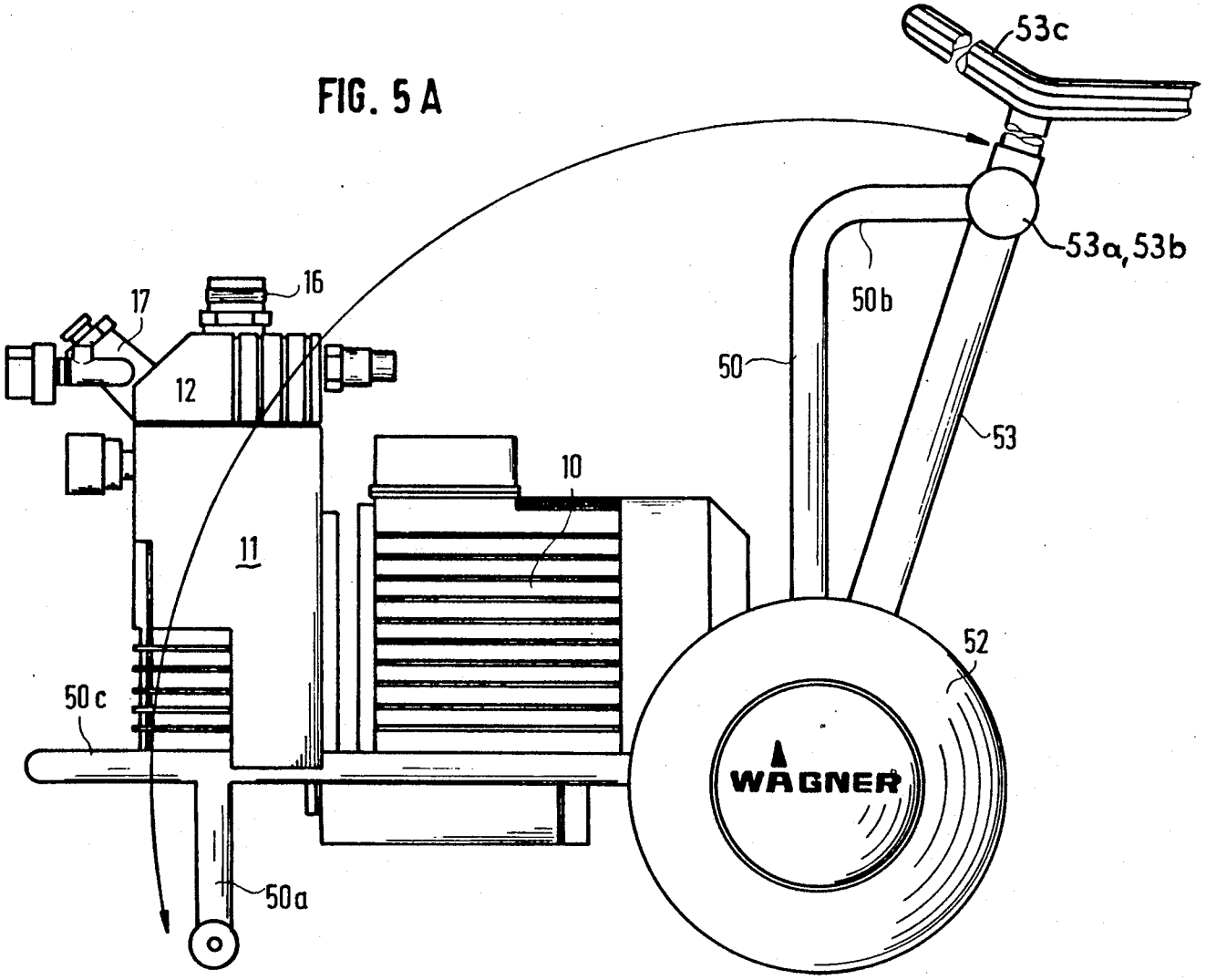
FIG. 5A is an elevational view of the diaphragm pump connected to a floor type frame and undercarriage, in the first position.
Figure 5B:
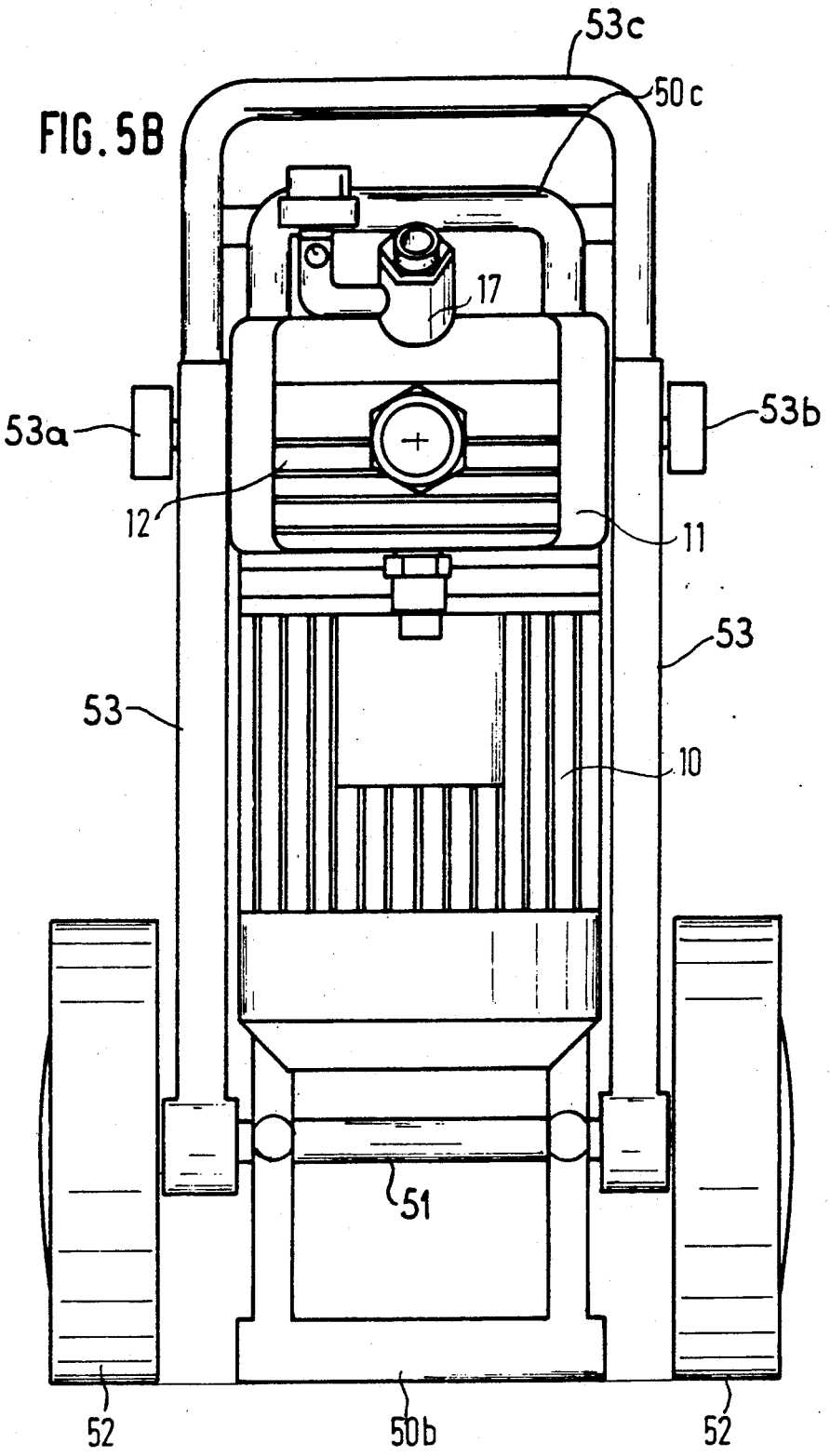
FIG. 5B is an elevational view of the diaphragm pump connected to the floor type frame and undercarriage, in the second position.
Figures 5C, 5D:
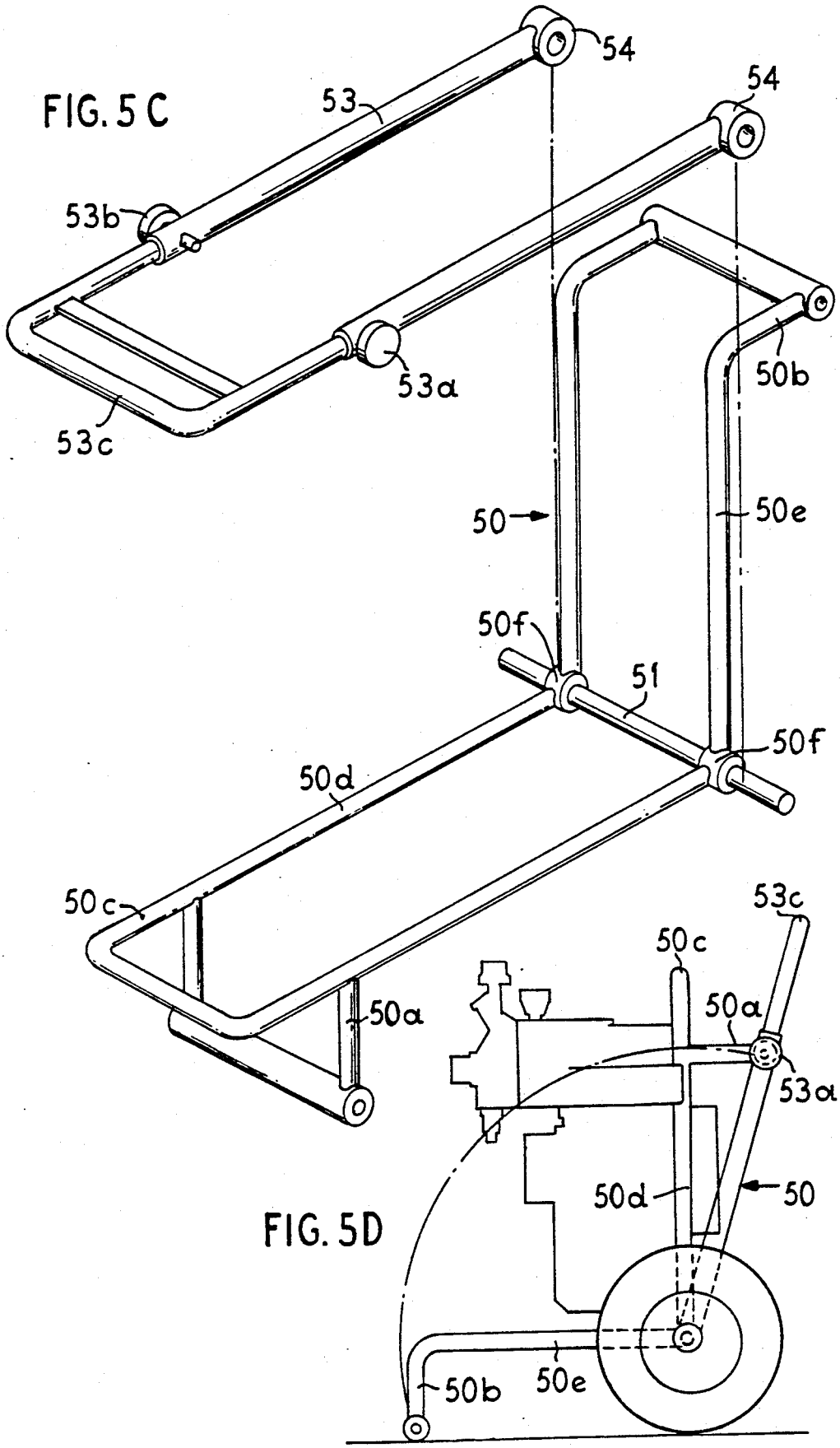
FIG. 5C is a perspective view of the floor type frame and undercarriage of FIGS. 5A and 5B in a disassembled manner with the diaphragm pump removed.
FIG. 5D is an elevational side view of the diaphragm pump connected to the floor type frame and undercarriage in the second position as shown in FIG. 5, but rotated 90° from FIG. 5B.

Another possible embodiment of a diaphragm pump-frame-unit is shown in the FIGS. 5A and 5D, whereby a mobile frame is involved. A tubular chassis frame 50 in the shape of an elongated rectangle, which has been bent a number of times is, looking at it from a side showing its length (FIGS. 5A and 5D) angled in an L shape having a first U shaped bending 50D and a second U shaped bending 50*e*, open ends of said U shaped bendings connected together at 50*e*. At the intersection 50*f* of the two bendings a wheel axle 51, which holds two wheels 52, is mounted, spanning a width of the elongated rectangle of the frame 50. Outer end portions 50*a* and 50*b* of the tubular chassis frame 50 are bent again, namely towards an outside of the L shape. Furthermore, a handle bar 53 is rotatably mounted at a lower end 54 to the wheel axle 51 and can be fixed at the end portion 50*a* as well as at the end portion 50*b* near a top end of the handle bar 53. In the position shown in FIG. 5A, the handle bar 53 is captured at the end portion 50*b* using releasable fixing locks 53*a*, 53*b*, and the end portion 50*a* represents a foot. In the second position shown in FIGS. 5B and 5D the handle bar 53 is captured at the end portion 50*a* with locks 53*a*, 53*b*, and the end portion 50*b* represents an alternate foot. By simply pivoting the handle bar 53 and capturing the same at one of two end portions, the diaphragm pump can be moved and/or put up in the desired position. An eighth pipe bend 50*c* shown in FIGS. 5A, 5B, and 5C, merely represents a protection for the diaphragm pump if it is in the position of FIG. 5A. A gripping handle 53*c* is located at a free end of the handle bar 53.

Naturally, the invention can be modified in numerous ways without leaving the field of the invention. Thus, it is possible, for example, to provide the paint inlet valve with a 45°-adjustment which is generally only useful, however, if the paint inlet valve is an unguided valve as well. That is, the valve identified with reference numeral 17 in the figures could represent the inlet valve rather than the outlet valve. Furthermore, it is understood that may embodiments are conceivable and applicable for the hand carrier or the undercarriage as well as for the casing provided with feet.

Although the present invention has been described with reference to a specific embodiment, those of skill in the art will recognize that changes may be made thereto without departing from the scope and spirit of the invention as set forth in the appended claims.

I claim as my invention:

1. A diaphragm pump orientable in a first operating position comprising:

a pumping component having an inlet valve and an outlet valve, receiving fluid through said inlet valve and discharging fluid through said outlet valve driven by pressure forces from propulsion liquid;

a hydraulic component, having an intake line, and holding the propulsion liquid therein and communicating propulsion liquid to said pumping component through said intake line, said intake line having a suction port submerged beneath an inventory level of the propulsion liquid residing inside the hydraulic component;

a propulsion means for delivering propulsion liquid under pressure into said pumping component;

at least one of said outlet and inlet valves comprising an unguided valve which is canted by an oblique angle upwardly relative to the horizontal in said first operating position, and maintains an upward inclination when said pump is oriented in a second position rotated 90° from said first position, said suction port of said intake line being oriented so as to be submerged beneath said inventory level in said second position.

2. A diaphragm pump according to claim 1, wherein said hydraulic component further comprises a charging hole with a measuring stick inserted therein for measuring the inventory level of the propulsion liquid within said hydraulic component, said charging hole and measuring stick arranged at an oblique angle with respect to the horizontal, such that the measuring stick functions in both said first position and said second position of said diaphragm pump.

3. A diaphragm pump according to claim 2 wherein said measuring stick is marked to function accurately in both said first position and said second position.

4. A diaphragm pump orientable in a first operating position comprising:

a pumping component having an inlet valve and an outlet valve, receiving fluid through said inlet valve and discharging fluid through said outlet valve driven by pressure forces from propulsion liquid;

a hydraulic component, having an intake line, and holding the propulsion liquid therein and communicating propulsion liquid to said pumping component through said intake line, said intake line having a suction port submerged beneath an inventory level of the propulsion liquid residing inside the hydraulic component;

said hydraulic component further comprising a charging hole with a measuring stick inserted therein for measuring the inventory level of the propulsion liquid within said hydraulic component, said charging hole and measuring stick arranged at an oblique angle with respect to the horizontal, such that the measuring stick functions in both said first position and said second position of said diaphragm pump;

a propulsion means for delivering propulsion liquid under pressure into said pumping component;

and said diaphragm pump is orientable in a second operating position wherein said pump is canted 90°, said suction end of said intake line being positioned to remain submerged beneath the inventory level of the propulsion liquid;

said outlet valve being an unguided valve and being canted by an oblique angle upwardly relative to the horizontal in said first position and maintaining an upward inclination when said pump is oriented in said second position;

and said propulsion means comprising an eccentric located within said hydraulic component partially submerged under the inventory level of the propulsion fluid residing therein, when said pump is oriented in both said first position and said second position.

5. A diaphragm pump according to claim 1 wherein said outlet valve is an unguided valve and is arranged axially at a 45° cant relative to the horizontal and located on a side of said pumping component, when said diaphragm pump is in said first operating position, such that canting of said diaphragm pump to said second operating position said outlet valve remains canted 45° to the horizontal.

6. A diaphragm pump according to claim 1 wherein said inlet valve is an unguided valve and is canted by 45° relative to the horizontal such that said inlet valve has the same inclination relative to the horizontal in both said first position and said second position of the diaphragm pump.

7. A diaphragm pump according to claim 1 wherein said inlet valve is a guided valve oriented vertically axially upward in said first position and oriented horizontally axially in said second position.

8. A diaphragm pump according to claim 1 wherein said propulsion means comprises:

a motor mounted to said hydraulic component providing rotational force, said motor penetrating said hydraulic component with a drive shaft, said motor mounted laterally to said hydraulic component when said pump is oriented in said first position;

an eccentric, mounted to said shaft for rotation;

a piston engaged by said eccentric to drive said piston reciprocally to exert a pressing force on said propulsion liquid;

and said pumping component is located above said hydraulic component in said first position, and said eccentric is located within said hydraulic component partially submerged at a select depth into said propulsion liquid;

and when said pump is canted to said second position said eccentric remains partially submerged in said propulsion liquid.

9. A diaphragm pump according to claim 8 wherein said eccentric comprises an eccentric bearing.

10. A diaphragm pump according to claim 1, wherein said diaphragm pump further comprises a housing-like casing having supporting feet for both said first position and said second position of said pump.

11. A diaphragm pump according to claim 1, wherein said pump further comprises a floor support/carrying frame comprising at least one multiply bent elongated structural member, supporting said pump off of grade, said frame providing a first standing surface for the pump in said first position, and a second standing surface for said pump in said second position, and a user carrying handle.

12. A diaphragm pump according to claim 11 wherein said multiply bent elongated structural member comprises a hollow cylinder cross section.

13. A diaphragm pump according to claim 11 wherein said multiply bent elongate structural member comprises a first U-shaped bent and a second U-shaped bent, said U-shaped bents arranged laterally in a spaced apart posture having open ends of said U-shape bents facing upwardly, and the closed segment of said U-shaped bents acting together as said first support surface, said first U-shaped bent having a first and second upstanding leg and said second U-shaped bent having a third and fourth upstanding leg, said first upstanding leg connected to said third upstanding leg and said second upstanding leg connected to said fourth upstanding leg by two horizontally arranged cross members, said cross members also acting as a handle for movement of said frame when said pump is in said first position; and when said pump is canted to said second position said second upstanding leg and said fourth upstanding leg act to provide said second support surface for said pump and said first upstanding leg and said third upstanding leg provide a handle for movement of said pump.

14. A diaphragm pump according to claim 1, further comprising a floor supporting mobile frame comprising an L-shaped member having an axle rotatably mounted at the corner of the L-shaped member, said axle holding two wheels for rolling said pump and frame, and a handle bar pivotally attached at said axle and releasably lockable to said frame in two orientations, said frame operable to support said pump in said first position of said pump, supported by said wheels and a first leg of said L-shaped member, said frame also operable to support said pump in said second position of said pump, supported by said wheels and a second leg of said L-shaped member, said two orientations of said handle bar comprising a first orientation located in a selected position for transporting said pump in said first position, said second orientation located in a selected position for transporting said pump in said second position.

15. A diaphragm pump according to claim 14 wherein said first leg of said L-shaped member and said second leg of said L-shaped member each have outwardly extending portions with respect to an inside of said L-shaped member, said outwardly extending portions providing feet to support said pump off grade.

16. A diaphragm pump according to claim 15 wherein said outwardly extending portions are outwardly bent ends of said first and said second legs.

17. A diaphragm pump according to claim 14 wherein said L-shaped member comprises an elongated rectangle bent into said L-shape.

18. A diaphragm pump according to claim 17 wherein said elongated rectangular member comprises a tubular frame.

* * * * *